US005203140A

United States Patent [19]

Jamieson

[11] Patent Number: 5,203,140

[45] Date of Patent: Apr. 20, 1993

[54] BEVERAGE CONTAINER AND METHOD OF FILLING IT

[75] Inventor: James G. Jamieson, Mauldon, England

[73] Assignees: Whitbread PLC, London, United Kingdom; Heineken Technisch Beheer B.V., Amsterdam, Netherlands

[21] Appl. No.: 781,127

[22] PCT Filed: Jul. 2, 1990

[86] PCT No.: PCT/GB90/01017

§ 371 Date: Mar. 6, 1992

§ 102(e) Date: Mar. 6, 1992

[87] PCT Pub. No.: WO91/00825

PCT Pub. Date: Jan. 24, 1991

[30] Foreign Application Priority Data

Jul. 6, 1989 [GB] United Kingdom ..... 8915532

[51] Int. Cl.[5] ..... B65B 3/04; B65B 31/00; B65B 25/02

[52] U.S. Cl. ..... 53/432; 53/97; 53/129.1; 53/403; 426/115

[58] Field of Search ..... 53/432, 431, 408, 405, 53/403, 402, 401, 129.1, 510, 97, 96, 95, 88, 84, 79; 426/115, 112

[56] References Cited

U.S. PATENT DOCUMENTS 3,802,056 4/1974 Jaeger ..... 53/440 X 4,947,650 8/1990 Blanton et al. ..... 53/127 X

*Primary Examiner*—James F. Coan

*Attorney, Agent, or Firm*—Sughrue, Mion, Zinn, Macpeak & Seas

[57] ABSTRACT

A method of packaging a beverage container includes placing an open-topped secondary chamber with an orifice into an open container before or after the container is filled with a beverage, displacing substantially all of the oxygen from the open container and the secondary chamber, and closing the open container, thereby closing the open-top of the secondary chamber, such that the only communication between the secondary chamber and the inside of the container is via the orifice.

13 Claims, 1 Drawing Sheet

BEVERAGE CONTAINER AND METHOD OF FILLING IT

This invention relates to packaging beverages in non-resealable containers. It is especially relevant for packaging carbonated beverages such as lagers, ales, stout and carbonated soft drinks in metal cans.

BACKGROUND OF THE INVENTION

Many attends have been made to generate a foam or head when dispensing a beverage from a container and when dispensing a beverage from a non-resealable container in particular, use has been made of a secondary chamber located inside the container and in communication with the inside of the container via a small orifice. The secondary chamber is charged with a superatmospheric pressure and is usually in equilibrium, via the orifice, with the contents of the container. When the container is broached so that its internal superatmospheric pressure is suddenly vented, the remaining superatmospheric pressure in the secondary chamber generates a rapid turbulent flow of gas or beverage through the orifice into the beverage inside the container which generates a quantity of gas bubbles which, as they rise through the beverage in the container, seed the creation of further bubbles so resulting in the generation of a required head either on the beverage inside the container or on the beverage as it is dispensed from the container by pouring into a glass or other receptacle.

GB-A-1266351 describes an early, not commercially successful system using a secondary chamber in which the secondary chamber is charged with gas as part of an initial filling or subsequent pressurising step. In an alternative described in GB-A-2183592 the pressure in the container builds up after it is sealed and as a result the beverage from the container enters the secondary chamber via the small orifice.

The packaging of a beverage in a container, particularly a carbonated beverage should maintain the beverage out of contact with oxygen. The presence of oxygen inside the container leads to the beverage being oxidised with a resulting impairment of flavour and risk of microbial growth leading to, for example, acetification of the resulting beverage when it contains alcohol. Thus, there is a general requirement to displace substantially all of the oxygen from a container, and its secondary chamber, when this is used, before the container is sealed. When the secondary chamber has the form of a hollow insert with only a small orifice in its wall and this insert is filled with air it is difficult to displace all of the air during the filling and sealing of such a container.

As a way of overcoming this problem GB-A-2183592 describes manufacturing such a secondary chamber by a blow moulding technique using an inert gas to form the secondary chamber and then only forming the orifice as the secondary chamber is placed into the container, for example by irradiation with a laser beam. However, in practice, this is not the way that such containers are filled. In practice, the secondary chamber is injection moulded and has its small orifice formed in its wall. After its formation, the normal atmospheric gases diffuse into and fill the secondary chamber. Such a secondary chamber is then inserted into an empty container and the whole is subjected to a reduced pressure, filled with an unoxidising gas such as carbon dioxide, nitrogen, or a mixture of these, and evacuated again to flush substantially all of the oxygen from both the inside of the container and the inside of the secondary chamber before the container is filled with beverage. In this way the amount of oxygen remaining in the sealed container is reduced to an acceptable level but these additional evacuation and flushing steps add a considerable delay and difficulty to the container filling stage with the result that the speed of filling is reduced to about 25 per cent of that in systems in which a secondary chamber is not included in the container

SUMMARY OF THE INVENTION

According to this invention a method of packaging a beverage container comprises placing an open-topped secondary chamber with an orifice in its wall into an open-topped container before or after the container is filled with a beverage, displacing substantially all of the oxygen from the open-topped container and the open-topped secondary chamber, and closing the open container and, in so doing, closing the open-top of the secondary chamber so that, thereafter, the only communication between the secondary chamber and the inside of the container is via the orifice.

In accordance with this invention, by providing a secondary chamber with an open top which is only closed upon sealing the open-topped container it is possible to use the same oxygen displacement technique as used on conventional container filling equipment without the need for any additional oxygen removal and flushing steps. Thus, for example, the oxygen may be displaced from both the container and the secondary chamber by flushing with a non-oxidising gas as part of the filling process. In any event, the open end of the secondary chamber enables the oxygen to be displaced readily and rapidly from it at substantially the same time that oxygen is displaced from the remainder of the container and accordingly no additional delay is imposed on the filling cycle. Thus using the method in accordance with this invention containers containing a secondary chamber may be filled at substantially the same rate as those without a secondary chamber.

Preferably the container and/or the secondary chamber is dosed with a solidified or liquified, non-oxidising gas in between its filling with the beverage and its closure. As the solidified or liquified non-oxidising gas vapourises it firstly displaces oxygen from the inside of the container and secondly, assuming that the container is closed whilst at least some of the gas is still present in its solid or liquid form, pressurises the container by at least part of the gas vapourising after the container is closed. The dosing with the solidified or liquified non-oxidising gas may be applied only to the inside of the open topped secondary chamber when it is required that the secondary chamber be filled substantially only with gas under pressure or, alternatively, it may be applied to the beverage in the container and/or the inside of the secondary chamber when it is required that the secondary chamber should contain beverage. In the latter case vapourisation of the solidified or liquified non-oxidising gas can act to drive the beverage through the small orifice into the secondary chamber after the container is closed or the beverage may be introduced deliberately into the inside of the open topped chamber as part of the filling process.

Preferably, at least part of the secondary chamber is captured between the container and its closure on closing of the open-topped container to hold the secondary chamber in place with its open top in sealing engagement with the closure.

Preferably the secondary chamber includes a surrounding flange which extends around the entire joint between the container and its closure and which forms a sealing gasket located between the container and its closure. In this case the flange is preferably perforated to allow beverage to flow through it. Preferably the secondary chamber and flange are shaped so that before the closure member is fixed to the container the open top of the secondary chamber stands proud of the inner rim of the container so that as the closure is applied to the container the closure is first urged against the open top of the chamber and then further downward movement of the closure member to close and seal the container provides an initial loading to urge the closure against the open top of the secondary chamber to form a seal between them. Preferably the secondary chamber is made from compliant and resilient material to improve its function as gasketing material, to provide the necessary resilience to form an effective seal between the open top of the secondary chamber and the closure member and to provide the initial loading.

The size of the orifice in the wall of the secondary chamber depends upon whether the secondary chamber ejects gas or liquid to generate a head in the beverage. When it is intended that the secondary chamber contains substantially only gas the orifice is preferably 0.5 mm or less in diameter, and preferably 0.2 mm, or even more preferably 0.1 mm in diameter. However, when it is required that the secondary chamber contains liquid which is ejected under pressure to form the head then the size of the orifice should be somewhat larger, typically in a range from 0.2 to 1 mm and preferably around 0.4 mm. More than one orifice may be provided in the side wall of the secondary chamber. When it is required to create the head by ejecting gas from the secondary chamber preferably the orifice is located in the side wall of the chamber away from its base so that any liquid that enters the secondary chamber does not interfere with the ejection of gas from the inside of the secondary chamber. Equally, when it is required to eject liquid from the secondary chamber it is preferred that the orifice is located towards the base of the side wall or in the bottom wall of the secondary chamber so that substantially all of the liquid in the secondary chamber is ejected.

The seal between the open end of the secondary chamber and the closure may be improved by the addition of a mastic sealing compound to the closure member, the rim of the open top of the secondary chamber, or both.

The non-oxidising gas is preferably nitrogen. However, it may be any convenient non-oxidising gas which does not adversely taint or react with the beverage and preferably is insoluble or of low solubility in beer so that it remains in gaseous form over long periods.

It is very much preferred that the container is a substantially conventional beverage can typically having a volume of between 250 ml and 3 liters and the closure is formed by the end of the can which typically includes an opening means such as a removable ring pull tear open device or a captive can puncturing device usually referred to as a stay-on-tab.

BRIEF DESCRIPTION OF THE DRAWINGS

Particular examples of methods in accordance with this invention will now be described with reference to the accompanying drawings, in which.

DETAILED DESCRIPTION OF THE PREFERRED EMBODIMENTS

Figure 1:
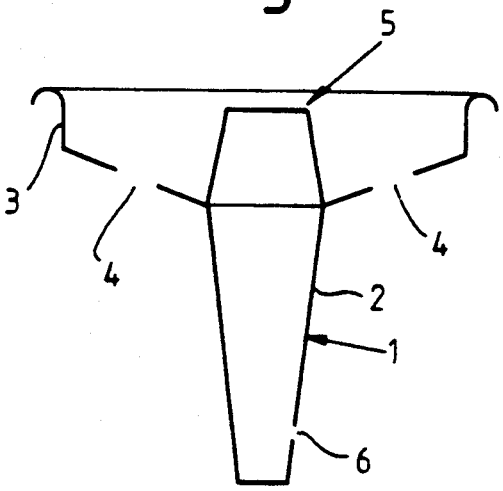
FIG. 1 is a section through a secondary chamber.
Figure 3:
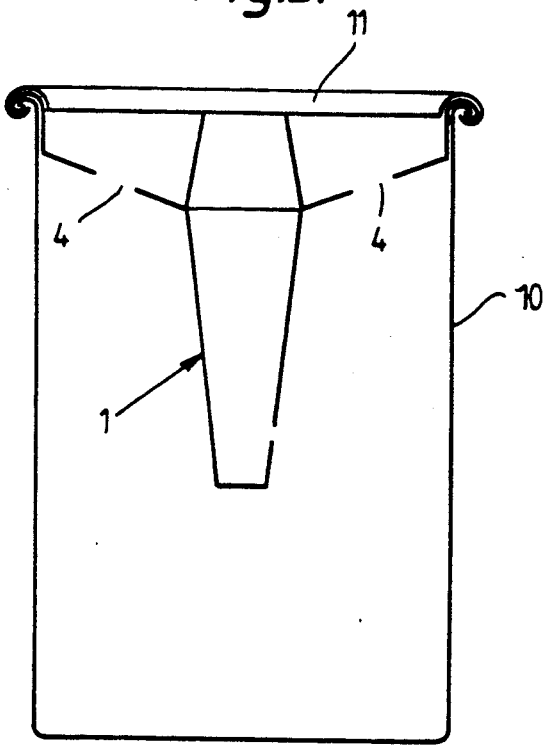
FIG. 3 is a cross-section showing the completed package with the secondary chamber fixed inside the completed package.
Figure 2:
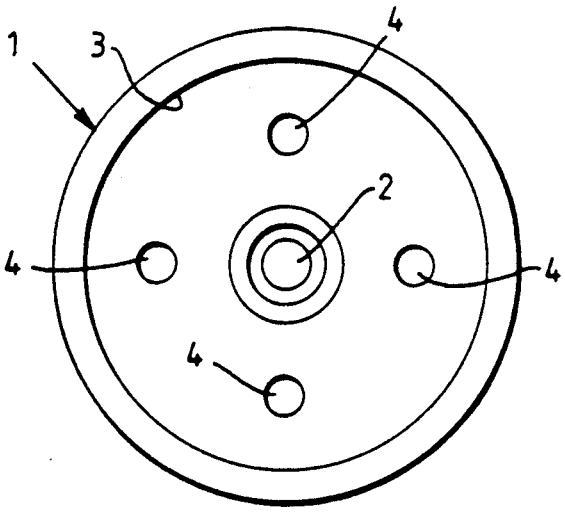
FIG. 2 is a plan of the secondary chamber.

The secondary chamber 1 comprises a generally tubular portion 2 with a closed end and a surrounding, radially extending flange portion 3. The secondary chamber 1 is moulded from a resilient plastics material such as low density polypropylene. The flange 3 includes apertures 4. A top rim 5 of the tubular portion 2 may include a reduced thickness sealing lip portion and the side wall of the tubular portion 2 includes an orifice 6.

In a first example a container 10 is filled with a carbonated beverage such as stout and then the secondary chamber 1 is inserted into the liquid filled container. Liquid nitrogen is introduced into the open top of the container 1 and at least part of this enters the inside of the tubular portion 2 of the secondary chamber 1. As the liquid nitrogen boils off it displaces oxygen from the inside of the tubular portion 2 of the secondary chamber 1 and from the open top of the container 10. A can lid 11 forming a closure is then placed on top of the open container 10 and engages the top rim 5 of the secondary chamber 1. The periphery of the flange 3 of the secondary chamber is sandwiched between the periphery of the lid 11 and the top rim of the can 10. The lid 11 is then crimped onto the top of the container 10 with the periphery of the flange 3 forming a sealing gasket between the container 10 and its lid 11.

After the container is closed liquid nitrogen remaining in the tubular portion 2 of the secondary chamber 1 continues to vapourise to pressurise the inside of the container 10. As the pressure builds up inside the tubular portion 2 any pressure in excess of that subsisting outside the tubular portion 2 results in nitrogen gas bubbling through the orifice 6 and into the inside of the container 10 to equalise the pressure inside the secondary chamber and the inside of the container.

In a second example in accordance with this invention the secondary chamber 1 is placed on top of the can before the can is then filled with beverage. As part of filling the can with beverage some beverage is introduced into the inside of the tubular portion 2 of the secondary chamber 1. A dose of liquid nitrogen is then introduced into the top of the can 10 and the lid 11 is seamed onto the top of the can again sandwiching the rim of the flange 3 between the lid 11 and the top of the can 10. Depending upon the quantities of nitrogen in the liquid state remaining inside and outside the secondary chamber 1, after the lid 11 is sealed to the can, liquid flows through the orifice 6 to equalise the pressures inside and outside the secondary chamber. By dosing liquid nitrogen only into the outside of the can it is possible to introduce liquid into the inside of the tubular portion 2 of the secondary chamber 1 via the orifice 6 without introducing any initially into the secondary chamber 1 during the filling operation. In this example the orifice 6 is located in the base of the tubular portion or in the side wall immediately adjacent the base.

To dispense the beverage from the containers, a ring pull, stay-on-tab or other device forming part of the lid 11 is released which in turn releases the pressure subsisting in the container rapidly to atmospheric pressure. The superatmospheric pressure subsisting in the tubular portion 2 of the secondary chamber 1 then drives gas or liquid out of the secondary chamber 1 via the orifice 6 to generate small uniform bubbles of foam which, in turn, seed the generation of further quantities of foam in the beverage in the container 1 above the orifice 6 as the bubbles rise to the surface of the beverage in the container. As the liquid is poured out of the container 10 it passes through the apertures 4 in the flange of the secondary chamber 1. In general the initial portion of the beverage which is dispensed includes a number of small uniform bubbles and these act to seed the generation of further bubbles in the remainder of beverage which is dispensed subsequently.

I claim:

1. A method of packaging a beverage container (10), comprising:

placing an open-topped secondary chamber (1) having a wall with an orifice (6) into an open container (10) one of before and after the container (10) is filled with a beverage;

displacing substantially all oxygen from the open-topped container (10) and the open-topped secondary chamber (1); and closing the open-topped container (10), thereby closing the open-top of the secondary chamber (1) so that the orifice (6) provides the only communication between the secondary chamber (1) and the inside of the container (10).

2. A method according to claim 1, further comprising dosing at least one of the open-topped container and secondary chamber with one of a solidified and liquified, non-oxidising gas between filling the container with the beverage and closing the container, to displace oxygen from the inside of said at least one of the container (10) and the secondary chamber and to pressurise the container (10).

3. A method according to claim 2, further comprising applying said one of the solidified and liquified non-oxidising gas only to the inside of the open-topped secondary chamber (1) such that the secondary chamber (1) is filled substantially only with gas.

4. A method according to claim 2, in which said one of the solidified and liquified non-oxidising gas is applied to one of the beverage in the container (10) and the beverage in the container (10) and the inside of the secondary chamber (1) when the chamber (1) is to contain the beverage, vapourisation of the one of the solidified and liquified non-oxidising gas forcing the beverage through the orifice (6) into the secondary chamber (1) after closure of the container (10).

5. A method according to claim 1, in which the beverage is introduced into the inside of the open-topped chamber (1) as part of the filling process.

6. A method according to claim 1, in which at least part of the secondary chamber (1) is engaged between the container (10) and a closure member (11) upon closing the open-topped container (10) to hold the secondary chamber (1) in place with the open top thereof in sealing engagement with the closure member (11).

7. A method according to claim 6, in which the secondary chamber (1) includes a surrounding flange (3) which extends around an entire joint between the container (10) and the closure (11) and which forms a sealing gasket located between the container (10) and the closure member (11).

8. A method according to claim 7, in which the flange includes perforations (4) to allow the beverage to flow therethrough.

9. A method according to claim 7, further comprising shaping the secondary chamber and flange such that before the closure member (11) is fixed to the open-topped container (10) the open top of the secondary chamber (1) stands proud of the inner rim of the container (10) so that as the closure member (11) is applied to the container (10) the closure member (11) is first urged against the open top of the chamber (1) and subsequent downward movement of the closure member (11) to close and seal the container (10) provides an initial loading to urge the closure member (11) against the open top of the secondary chamber (1) to form a seal therebetween.

10. A method according to claim 1, in which the diameter of the orifice (6) in the wall of the secondary chamber (1) is no more than 0.5 mm when the chamber (1) contains only gas and is from 0.2 to 1 mm when the chamber includes a beverage.

11. A method according to claim 9, in which the seal between the open end of the secondary chamber (1) and the closure member (11) includes a mastic sealing compound applied to at least one of the closure member (11) and a rim of the open top of the secondary chamber (1).

12. A holder adapted to hold a beverage, comprising:

a container (10), an open-topped secondary chamber (1) which includes a wall with an orifice (60 such that the inside of the secondary chamber (1) is in communication with the inside of the container (10) via the orifice (6); and a closure (11) for closing the open top of the secondary chamber (1), at least part of the secondary chamber (1) being engaged between the container (10) and the closure (11) to hold the secondary chamber (1) in place with the open top thereof in sealing engagement with the closure (11).

13. A beverage holder made by a method comprising the steps of:

placing an open-topped secondary chamber (1) having a wall with an orifice (6) into an open container (10) one of before and after the container (10) is filled with a beverage;

displacing substantially all oxygen from the open container (10) and the open-topped secondary chamber (1); and closing the open container (10), thereby closing the open-top of the secondary chamber (1) so that the orifice (6) provides the only communication between the secondary chamber and the inside of the container (10), to produce the beverage holder.

* * * * *